United States Patent [19]

Sen Gupta

[11] Patent Number: 4,638,557

[45] Date of Patent: Jan. 27, 1987

[54] SEMI-AUTOMATIC APPARATUS FOR ATTACHING FLYPIECES TO A SLIDE FASTENER CHAIN

[75] Inventor: Sisir K. Sen Gupta, Meadville, Pa.

[73] Assignee: Talon, Inc., Meadville, Pa.

[21] Appl. No.: 821,975

[22] Filed: Jan. 24, 1986

[51] Int. Cl.[4] ..... B21D 53/50; A41H 37/06

[52] U.S. Cl. ..... 29/766; 29/33.2

[58] Field of Search ..... 29/33.2, 408–410, 29/766–770

[56] References Cited

U.S. PATENT DOCUMENTS

| | | | |
|---|---|---|---|
| 2,823,388 | 2/1958 | Prupis | 29/33.2 |
| 3,570,104 | 3/1971 | Jensen | 29/408 |
| 4,598,454 | 7/1986 | Yunoki | 29/33.2 |
| 4,606,100 | 8/1986 | Yunoki | 29/408 |
| 4,608,745 | 9/1986 | Miyakawa | 29/408 |

FOREIGN PATENT DOCUMENTS 2021681 12/1979 United Kingdom ..... 29/766

*Primary Examiner*—Howard N. Goldberg
*Assistant Examiner*—Steven Nichols
*Attorney, Agent, or Firm*—Anthony A. O'Brien

[57] ABSTRACT

Fabric flypieces are placed randomly on a top plate of a unified flypiece feed apparatus which orients the flypieces and feeds them in succession to a sewing station at which they are united with a zipper chain either in end-to-end abutment or with a slight predetermined gap between the flypieces. A somewhat angled flypiece belt conveyor and a cooperative variable tension drag device above the conveyor orients the flypieces longitudinally and feeds them to the sewing station at a substantially greater speed than the united flypieces and zipper chain leave the sewing station. A photo-optical device senses the presence or absence of flypieces on the top plate and stops the sewing machine if the operator fails to load a flypiece within a predetermined time interval.

15 Claims, 4 Drawing Figures

SEMI-AUTOMATIC APPARATUS FOR ATTACHING FLYPIECES TO A SLIDE FASTENER CHAIN

BACKGROUND OF THE INVENTION

1. Field of the Invention

The present invention relates to a machine for attaching rectangular flypieces formed of scrap fabric to a continuous slide fastener chain. More particularly, the invention is concerned with a simplified and more efficient mechanism for receiving, orienting and feeding flypieces in succession to a sewing machine which stitches them to a slide fastener chain, with the flypieces in end-to-end abutting relationship, or slightly gapped at their ends, depending on the adjustment of the apparatus.

2. Description of the Prior Art

Prior U.S. Pat. No. 3,570,104, Jensen, discloses an apparatus and method for attaching scrap material flypieces to a slide fastener chain without the necessity for an operator to accurately place the flypieces in the apparatus. In the Jensen patent, however, the flypieces are engaged and advanced sequentially by continuously driven feed rolls arranged on opposite sides of the sewing machine. Since the pairs of feed rolls are essentially rigid and non-adjustable, the Jensen apparatus does not lend itself to ready adjustment in order to accommodate flypieces formed of different thicknesses or weights of fabric. Accordingly, one of the principal features and objectives of the present invention is to completely overcome this particular drawback of the prior art, by the provision of a flypiece conveyor or feed means which is relatively insensitive to fabric thickness, and may also be adjusted to accommodate variations in fabric thickness over a relatively wide range.

SUMMARY OF THE INVENTION

An important object of the present invention is to provide a unified adjustable apparatus for receiving flypieces randomly placed thereon by an unskilled operator, automatically orienting the flypieces in a proper longitudinal procession through the apparatus, and conveying them toward a sewing machine by means of which they are stitched to a slide fastener chain being delivered to the sewing machine from a supply of the chain. The apparatus embodying the present invention has the ability to convey or feed the flypieces properly oriented toward the sewing machine, at a speed substantially greater than the speed at which the united flypieces and slide fastener chain move out of the sewing machine. This assures that the flypieces are united with the slide fastener chain in end-to-end abutting, or nearly abutting, relationship, as determined by the adjustment of a precision flypiece drag device forming a part of the apparatus according to the invention.

Another object of the invention is to provide an apparatus of the class mentioned which greatly minimizes wasting slide fastener chain and enables an unskilled operator to load up to sixty flypieces per minute in the apparatus, which greatly exceeds the ability of even skilled personnel to load flypieces in machines known in the prior art.

A further object of the invention is to provide an apparatus of the mentioned type which employs somewhat yielding flypiece conveyor belts acting on the bottoms of the flypieces in cooperative relationship with an overhead adjustable drag device which acts on the tops of the flypieces. This arrangement assures positive feeding of the flypieces toward the sewing station and allows the use of various weights of scrap fabric for the flypieces with very little or no adjustment of the mechanism.

Another important object and feature of the invention resides in the placement of the flypiece conveyor belts at a small acute angle to the longitudinal movement path of the flypieces, whereby the latter are acted on by a biaxial force which serves to align or orient the flypieces correctly as they move to the sewing station.

Another object of the invention is to mount the unified flypiece orientation and feed mechanism on guide rails which enable the entire mechanism to be bodily moved laterally with respect to the sewing machine to facilitate servicing the latter at required times.

Still another object of the invention is to provide photo-optical sensing means in association with the flypiece conveying or feed means which can detect the absence of a flypiece in the procession moving through the apparatus and interrupt the operation of the sewing machine. The photo-optical means operates in a manner which requires the operator to place the next flypiece in the apparatus within a given predetermined period of time, if stopping of the sewing machine is to be avoided.

Other objects, advantages, and features of the invention will become apparent from the following specification when taken in conjunction with the accompanying drawings.

DESCRIPTION OF THE PREFERRED EMBODIMENT

Figure 1:
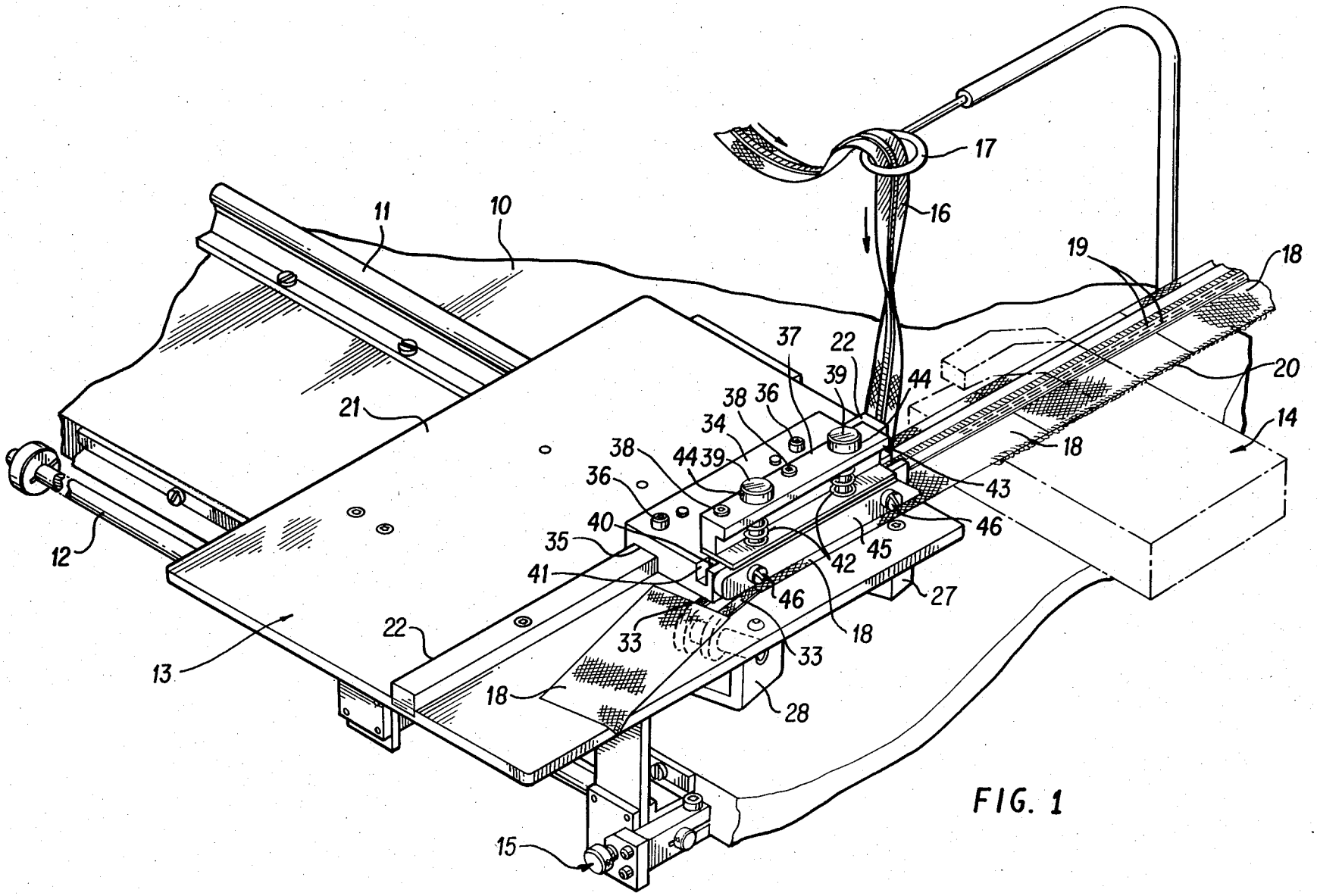
FIG. 1 is a perspective view of a semi-automatic apparatus for attaching flypieces to a slide fastener chain in accordance with the present invention.

Referring to the drawings in detail wherein like numerals designate like parts, a main support table 10 has a pair of fixed parallel support and guide rails 11 and 12 mounted thereon for the support and guidance of a flypiece orientation and feed apparatus 13 which forms the main subject matter of the present invention. The entire unified apparatus 13, at proper times, is released from its normal use position shown in FIG. 1, relative to a conventional sewing machine 14, so that the apparatus 13 can be moved along the rails 11 and 12 to clear the sewing machine 14 so that the latter can be serviced. A conventional releasable latch mechanism 15 is provided on the apparatus 13 to secure the apparatus in the normal use position and release it at required times so that it can be moved aside and will not obstruct the sewing machine 14 while the sewing machine is being worked on.

A slide fastener chain 16, coming from a source not shown, is engaged by a guide 17 during its movement toward the sewing station defined by the sewing machine 14, at which station flypieces 18 customarily formed of rectangular sections of scrap fabric are united with the chain 16 by two lines of stitching 19. The particular arrangement of the invention shown in the drawings is for sewing left-hand flypieces to the slide fastener chain 16. Simultaneously with sewing the flypieces 18 to the slide fastener chain 16, the conventional three needle sewing machine 14 may serge stitch the longitudinal edge of the product as indicated at 20.

The flypiece orientation and feeding apparatus 13 comprises a level rectangular top plate 21 supported by the rails 11 and 12 somewhat above the main table 10. Fixed to the top of the plate 21 is a longitudinal flypiece guide bar 22, adapted to engage one edge of each flypiece 18 and guide it on a proper path to the sewing station defined by the machine 14.

Beneath the top plate 21 and suitably secured to it is a gear head motor 23 having a drive timing pulley 24, operatively engaged with a timing belt 25, in turn driving a driven timing pulley 26. First and second shaft supports 27 and 28 attached to the bottom of the plate 21 support, respectively, a conveyor belt drive shaft 29 and a parallel conveyor belt support shaft 30.

The shaft 29 is directly driven by the pulley 26 and carries a pair of spaced conveyor belt pulleys 31. A pair of conveyor belt idler pulleys 32 is provided on the shaft 30. The supports 27 and 28 and their shafts 29 and 30 are disposed at an obtuse angle relative to and across the flypiece guide bar 22. Consequently, a pair of O-ring elastic conveyor belts 33 engaged with the pulleys 31 and 32 are disposed at an acute angle to the guide bar 22, preferably at an angle of approximately 15°. The two belts 33 are parallel and spaced and they converge toward the downstream end of the flypiece guide bar 22. The horizontal top runs of the belts 33 project slightly above the top face of the plate 21, and this plate is suitably cut out or slotted to receive the top runs of the two belts 33.

A flypiece guide plate 34 is provided above the top plate 21 and substantially overlies the belts 33. The guide plate 34 has a longitudinal groove 35 formed in its bottom from end-to-end thereof, and this groove receives the flypiece guide bar 22 with a precision fit. The flypiece guide plate 34 is firmly anchored by screws 36.

An adjusting screw mount 37 is provided atop guide plate 34 and rigidly secured thereto by screws 38. A pair of manual adjusting screws 39 is provided on the mount 37 and each screw is threadedly engaged with a slide block 40 engaged movably in a groove 41 of the guide plate 34. A pair of compression springs 42 surround the shanks of screws 39 and having their ends bearing on slide block 40 and an upper ledge 43 of the mount 37. These springs 42 urge the heads 44 of screws 39 downwardly into contact with the mount 37 and bias the slide block 40 downwardly in the groove 41.

Figure 4:
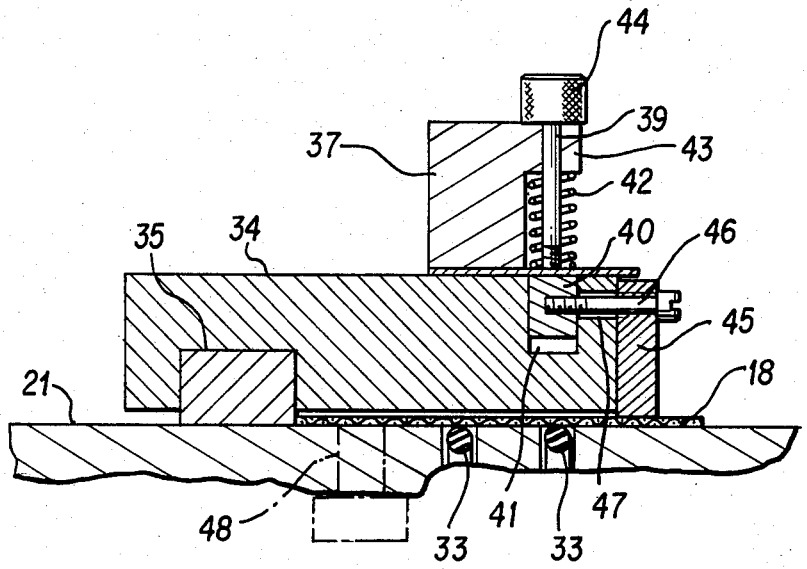
FIG. 4 is a fragmentary vertical section taken on line 4—4 of FIG. 3.
Figure 3:
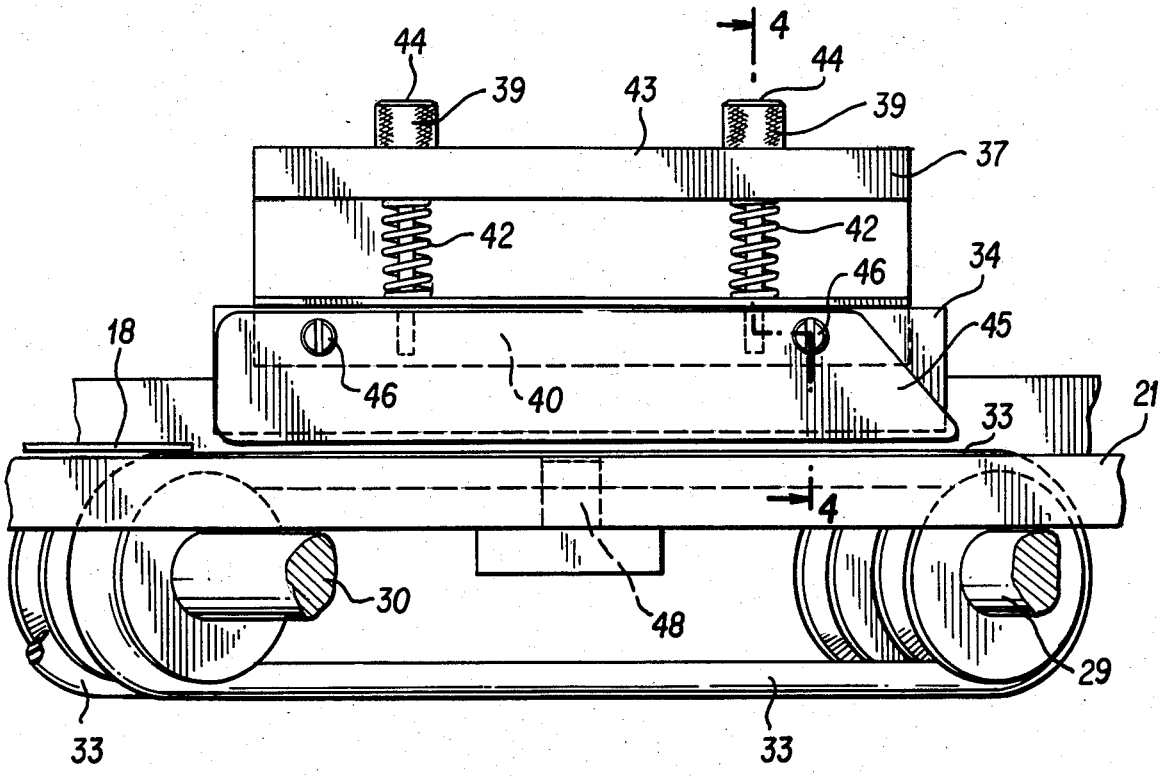
FIG. 3 is a fragmentary side elevation of the apparatus.

A flypiece drag plate 45 disposed forwardly of one longitudinal face of the guide plate 34 is secured to the slide block 40 by a pair of screws 46 disposed perpendicular to the adjusting screws 39. Clearance slots 47 provided in the plate 34 around the screws 46, FIG. 4, allow fine adjustment of the drag plate 45 upwardly and downwardly with the screws 46 relative to flypieces 18 passing beneath the guide plate 34 under influence of the conveyor belts 33.

By this means, a finely controlled friction drag can be exerted on the moving flypieces 18 as they pass toward the sewing machine 14. The degree of this drag exerted on the flypieces regulates their end-to-end spacing. When only a very light drag effect is present, the flypieces 18 have their ends abutting when they are stitching to the slide fastener chain 16. If a somewhat heavier drag is present through the adjustable plate 45, a uniform gapping or spacing of the ends of the flypieces, such as 1/16th inch spacing is enabled.

An important feature of the invention is that the angled conveyor belts 33 act on the randomly placed flypieces 18 with a biaxial force. This causes each flypiece as it is engaged with the belts 33 by the operator to be turned during its forward movement until its interior longitudinal edge moves into engagement with the guide bar 22. This aligns or orients each flypiece 18 on a proper longitudinal path of movement along the guide bar 22 toward the sewing machine needles so that the stitching lines 19 are properly applied to the flypieces and the slide fastener chain 16.

Another feature of the apparatus is that the conveyor belts 33 deliver the flypieces toward the sewing station approximately two to three times faster than the flypieces and the slide fastener chain are taken away from the sewing machine. This allows the unskilled operator adequate time to randomly place flypieces on the top plate 21, and allows each flypiece to catch up with the flypiece in front of it, when the flypiece in front is about 4"–5" ahead of the one being placed. This, in turn, allows the sewing machine 14 to operate continuously, which increases production significantly.

The adjustability of the drag plate 45 in addition to regulating the gapping between the ends of flypieces enables the apparatus to process flypieces of varying weights or thicknesses with little or no adjustment. Since the springs 42 exert a yielding force downwardly on the drag plate 45, the drag mechanism is somewhat self-adjusting to compensate for slight changes in thickness of the flypieces. When more abrupt thickness changes are encountered, fine adjustments can be made by means of the screws 44. In some cases, the flypiece guide plate 34 can also be adjusted vertically relative to the top plate 21.

The inherent flexibility of the belt 33 compared to the non-yielding feed rolls in U.S. Pat. No. 3,570,104 further enables the apparatus to accommodate different thicknesses of material while providing desired biaxial forces on the flypieces, as described.

Figure 2:
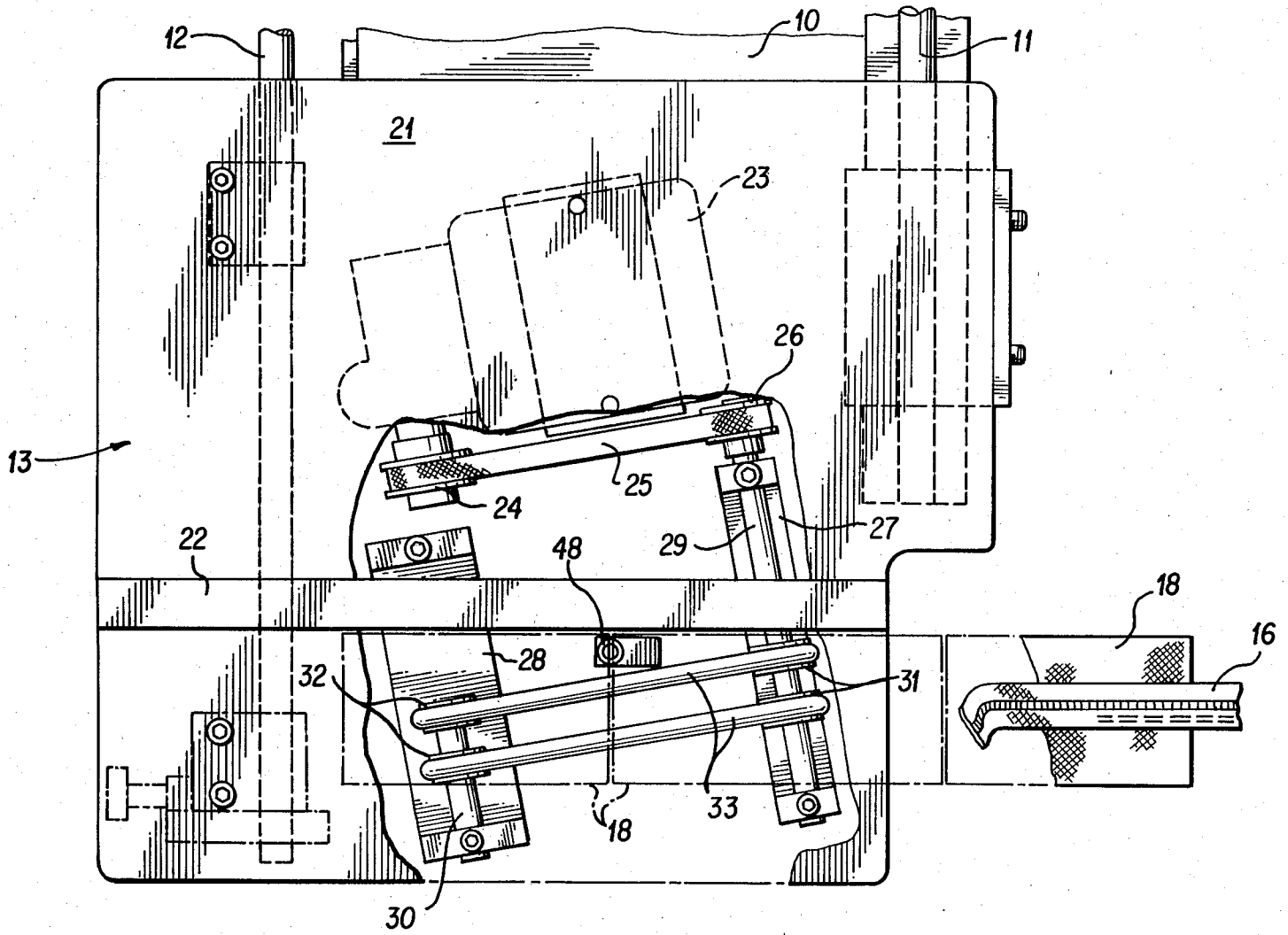
FIG. 2 is a plan view of the apparatus, partly broken away.

A photo-optical sensor 48 is provided within an opening of the top plate 21 near the longitudinal center of the inboard conveyor belt 33, FIG. 2. This sensor or scanner assures that the flypieces 18 are loaded within a given time interval. If an operator fails to deposit a flypiece on the plate 21, the sensor 48 will detect the gap between flypieces and terminate the operation of the sewing machine. The provision of the scanner 48 renders the apparatus foolproof and produces a quality product without waste of material.

Inasmuch as the present invention is subject to many modifications, variations, and changes in detail, it is intended that all of the material in the aforegoing specification or in the accompanying drawings be interpreted as illustrative, and not in a limiting sense.

I claim:

1. In a machine for attaching flypieces to a slide fastener chain, a sewing machine, means to deliver a slide fastener chain to a sewing station defined by the sewing machine, and an apparatus to receive, orient and convey flypieces to the sewing station in a required sequence, said apparatus comprising a top plate on which flypieces can be randomly placed, a flypiece guide bar on said top plate with which flypieces can be engaged and guided on a path of movement toward the sewing station, conveyor belt means having a top run projecting somewhat above the top face of said top plate and adapted to engage flypieces on the top plate and shift them into engagement with said guide bar while conveying the flypieces toward the sewing station, and a cooperative adjustable flypiece guide and drag producing means on the top plate in overlying relationship to said top run of said conveyor belt means, whereby the machine can process flypieces of varying thicknesses and can maintain a desired uniform gapping or substantial abutment between the ends of flypieces passing through the machine.

2. In a machine for attaching flypieces to a slide fastener chain as defined in claim 1, and said conveyor belt means comprising a pair of spaced substantially parallel round cross-section elastic belts, and power means on the apparatus drivingly connected with said belts to operate them at a required precision speed.

3. A machine for attaching flypieces to a slide fastener chain as defined in claim 1, and said conveyor belt means being disposed at an acute angle to said flypiece guide bar and converging therewith toward the sewing station.

4. A machine for attaching flypieces to a slide fastener chain as defined in claim 3, and the acute angle approximating 15°.

5. A machine for attaching flypieces to a slide fastener chain as defined in claim 2, and said conveyor belts being disposed at an acute angle to said flypiece guide bar and converging therewith toward the sewing station.

6. A machine for attaching flypieces to a slide fastener chain as defined in claim 1, and said flypiece guide and drag producing means comprising a flypiece guide plate fixed on said top plate and being spaced somewhat above the top plate and said top run, a slide block engaged movably with said flypiece guide plate and adapted to move toward and away from said top plate on a path substantially perpendicular thereto, adjusting screw means on the flypiece guide plate connected with the slide block to move it in opposite directions, and a drag plate connected with the slide block and being movable therewith relative to the flypiece guide plate and said top plate and adapted to engage and exert a restraining force on flypieces being conveyed by the conveyor belt means between the top plate and the flypiece guide plate along a linear path defined by said flypiece guide bar.

7. An apparatus for delivering rectangular flypieces of varying thicknesses to a sewing station where flypieces are united with a slide fastener chain by stitching, comprising a substantially level top plate, means supporting the top plate movably whereby the top plate can be held in a use position relative to a sewing machine and can be shifted laterally to a non-use position to facilitate servicing a sewing machine, a flypiece guide element on the top plate defining a linear movement path for flypieces toward a sewing station, conveyor belt means secured to the top plate including a top run disposed slightly above the top plate in a plane parallel thereto and being disposed at an acute angle to said flypiece guide bar, whereby the conveyor belt means can exert a biaxial force on each flypiece placed on the top plate and engaged with the conveyor belt means, and an adjustable flypiece guide and restraint means carried by the top plate in superposed relationship to the top plate and said top run of the conveyor belt means.

8. An apparatus as defined in claim 7, and said conveyor belt means comprising at least one round cross-section elastic belt, and means to drive the conveyor belt means and being attached to the top plate.

9. An apparatus as defined in claim 8, and the conveyor belt means comprising a pair of spaced parallel round cross-section elastic belts.

10. An apparatus as defined in claim 7, and said adjustable flypiece guide and restraint means comprising a flypiece guide plate fixed on said top plate in slightly spaced relationship thereto and to said top run, a slide block movably engaged with the flypiece guide plate and adapted to be shifted toward and away from the top plate, a flypiece restraint element connected with said slide block and being movable therewith toward and away from the top plate and adapted to engage flypieces being moved through the apparatus by the conveyor belt means to somewhat restrain their movement, and threaded adjusting means on the flypiece guide plate engaged with the slide block.

11. An apparatus as defined in claim 10, and said restraint element comprising an elongated plate disposed along one longitudinal edge of the flypiece guide plate and having a lower straight edge adapted to bear on the top faces of flypieces traveling through the apparatus.

12. An apparatus as defined in claim 10, and said threaded adjusting means comprising a pair of spaced parallel axis adjusting screws having threaded engagement with said slide block near opposite ends thereof, and a mount for the adjusting screws fixed on the flypiece guide plate.

13. An apparatus as defined in claim 12, and compression springs surrounding the adjusting screws and having opposite ends bearing against said mount and said slide block.

14. An apparatus as defined in claim 7, and a photo-optical means on said apparatus and being positioned thereon to sense the absence of a flypiece being conveyed through the apparatus whereby a sewing machine at the sewing station can be automatically stopped.

15. In a machine for attaching flypieces to a slide fastener chain as defined in claim 1, and a photoelectric sensing means on said apparatus operable to detect the absence of a flypiece in the apparatus so that the sewing machine can be automatically stopped.

* * * * *